United States Patent [19]

Friedrich

[11] Patent Number: 4,624,381

[45] Date of Patent: Nov. 25, 1986

[54] COLLAPSIBLE CONTAINER OR CARRYING CASE

[76] Inventor: Uwe W. Friedrich, Liebigstrasse, 4444 Bad Bentheim 1, Fed. Rep. of Germany

[21] Appl. No.: 690,796

[22] Filed: Jan. 11, 1985

[51] Int. Cl.[4] ..... B65D 6/26; B65D 55/02

[52] U.S. Cl. ..... 220/7; 220/214; 292/253; 292/307 R

[58] Field of Search ..... 220/6, 7, 214, DIG. 15; 292/253, 307 R, 318, 322, 288, 258

[56] References Cited

U.S. PATENT DOCUMENTS

| | | | |
|---|---|---|---|
| 3,080,087 | 3/1963 | Cloyd | 220/DIG. 15 |
| 3,330,437 | 7/1967 | Bellamy | 220/6 |
| 3,611,994 | 10/1971 | Bailey | 220/6 |
| 3,707,023 | 12/1972 | Pfaffendorf | 292/253 |
| 3,746,206 | 7/1973 | Utz | 220/214 |
| 3,753,586 | 8/1973 | Patterson | 292/307 R |
| 3,955,703 | 5/1976 | Zebarth | 220/6 |
| 4,005,759 | 2/1977 | Mikkelsen | 220/7 |
| 4,021,890 | 5/1977 | Kurosaki | 292/253 |

FOREIGN PATENT DOCUMENTS

| | | | |
|---|---|---|---|
| 2352533 | 4/1975 | Fed. Rep. of Germany | 220/6 |
| 1115352 | 4/1956 | France | 220/6 |
| 1467411 | 12/1966 | France | 220/6 |
| 2272907 | 12/1975 | France | 220/7 |
| 517408 | 2/1955 | Italy | 220/6 |

*Primary Examiner*—George E. Lowrance

*Attorney, Agent, or Firm*—Karl F. Ross; Herbert Dubno

[57] ABSTRACT

A collapsible container in which end and side walls are hinged to a rectangular base plate along the opposite short and long sides thereof. The vertical edges of the walls in their erect positions have ridges of triangular shape to abut at flanks lying diagonally. These flanks have formations enabling them to interengage. Cover plates have lips engaging in grooves of the side walls and are hinged to the end walls.

7 Claims, 9 Drawing Figures

COLLAPSIBLE CONTAINER OR CARRYING CASE

FIELD OF THE INVENTION

The invention relates to a collapsible container or carrying case.

BACKGROUND OF THE INVENTION

A collapsible carrying case of the type under discussion has been known for a long time (German Pat. No. 24 36 354). In this known collapsible carrying case, the side walls have corresponding guide members and guide recesses as well as locking elements, in order to provide a safe and secure connection between the side walls when the case is in the opened-up position. The second side walls which are articulated directly with the base plate have hinges which on the one hand are fastened to the base plate itself and on the other hand to the particular side wall concerned so that, when these side walls are folded inwardly and downwardly, they come to rest directly on the base plate of the carrying case. The first side walls which are indirectly articulated with the base plate by raised borders are at a somewhat greater distance from the base plate at their lower edge and when they are folded inwardly and downwardly they come to rest on top of the other second side walls which have already been folded down onto the base plate. In this case the guide recesses are in the form of eyelets and they are located on the first side walls. The guide members which are located on the second side walls engage in these guide recesses with the eyelet configuration when the carrying case is in the opened-up position. The eyelet-like guide recesses thus provide a certain amount of bearing contact by way of their borders for the second side walls in the opened-up position of the carrying case. In this way the second side walls are prevented from falling to the outside of the case. However, it has been shown that the guide recesses configured as eyelets are not sufficiently reliable in use as, amongst other things, they are liable to break off. Also, the stability of this type of carrying case in the opened-up position leaves a lot to be desired.

In addition to this there is another known collapsible carrying case which has two lids (German Pat. No. 27 34 964) which, on the one hand, provides good cover for the goods being transported in the carrying case and on the other hand improves the overall stability of the carrying case. However it is still possible to improve the stability of this carrying case even further. Apart from this, the protection against pilfering from the carrying case provided by the lids is not optimal because it is very easy to open them.

OBJECT OF THE INVENTION

It is an object of the present invention to improve the stability in the opened-up position, the reliability and the safety during transport of collapsible containers or carrying cases of the type hereinbefore described.

SUMMARY OF THE INVENTION

According to the present invention there is provided a collapsible container including a base plate and two pairs of oppositely located first and second side walls, said side walls being connected to said base plate by hinges and able to be folded inwardly and downwardly so that in the collapsed condition said first side walls lie on top of said second side walls, said side walls having guide members, and said first side walls having edge strips for the second side walls which extend for substantially the whole length of the edges which run perpendicular to said base plate when the side walls are in the opened-up position. Thus, in line with the invention, the guide recesses which up till now have been in the form of eyelets in the borders to form contact surfaces, have been considerably increased in contact surface area by combining them together into continuous strips which, on the one hand, considerably improve the stability of the collapsible container or carrying case in the opened-up or assembled position and, on the other hand, improves the reliability by lessening the danger of breaking off of the guide members. An additional advantage of the contact-surface strips as provided for in the invention is that, when the carrying case is in the folded-up position, they act as external protective strips for the hinged region of the second side walls where they run parallel to the base plate.

Preferably tongue-and-groove connections extending substantially for the whole of the edge strips of the side walls results in quite a large surface area of contact for locking the side walls together in the opened-up position of the carrying case.

Further preferred embodiments include the guide member having a substantially triangular cross section and, if required, they may be at an acute angle to the direction of the folding movement of the bearing surfaces of the second side walls, so that there will be an automatic adjustment of the positions of the side walls in relation to one another when the carrying case is unfolded into the opened-up position.

A form of construction of the carrying case in accordance with the invention which is especially preferred because of its resistance to warping and distortion in the opened-up position is achieved by including positive locking extensions which are provided on associated stiffening ribs on the bearing surfaces which intermesh somewhat in the fashion of a zip-fastener and lead to the situation that, in the opened-up position, the side walls cannot move in relation to one another in a direction perpendicular to the base plate. The relative positions of the side walls in the direction perpendicular to the base plate is determined by the engagement of the positive locking extensions. This allows very heavy loads to be carried in the carrying case without any danger of the side walls bursting apart due to warping or distortion of the side walls.

With respect to the preferred forms of the fabrication of the interlocking elements these may be made from a carbon-fibre reinforced synthetic material which leads to a very high degree of reliability with simultaneous high carrying capacity. Furthermore, there is naturally also the alternative, that the interlocking elements may be constructed as an integral part within the second side walls (or in the first side walls), in which case, however, it is necessary that the material which is predominantly used for the carrying case must also be used for the interlocking elements.

It is also recommended that the lids of the carrying case should not only be locked into position on the side wall but they should be locked to one another. Preferably a tongue-and-groove method is also chosen for the locking together of the lids.

Reference was made to the fact that safety during transport or security against pilfering from carrying cases of the type under discussion plays an important role. In accordance with a preferred aspect of the invention, the "open" side or top of the carrying case can be prepared in such a way with respect to the side walls and the lid that it is a very simple matter to seal off this "open" side once the case has been closed. Details of such sealing or locking devices are already known. In a further embodiment of the invention, the utilization of a locking device which is particularly suitable for the sealing of carrying cases includes a springy finger element which is provided on the locking device near the ends of the device which leads to the situation where the ends of the locking device only need to be inserted into the corresponding insertion openings in the lid or the side walls of the carrying case so that the finger elements open up after the insertion and the locking device can no longer be withdrawn from the case. The configuration of a Y-shaped device, is particularly suited to the pilfer-proof sealing of the carrying case by the connection of the two lids to each of the side walls. At all events these insertable locking devices are particularly advantageous for the carrying cases and should be made from flexible synthetic material.

BRIEF DESCRIPTION OF THE DRAWING

In-order that the invention may be readily understood and conveniently put into practical effect reference will now be made to the accompanying illustrative drawings, wherein.

SPECIFIC DESCRIPTION

Figure 1:
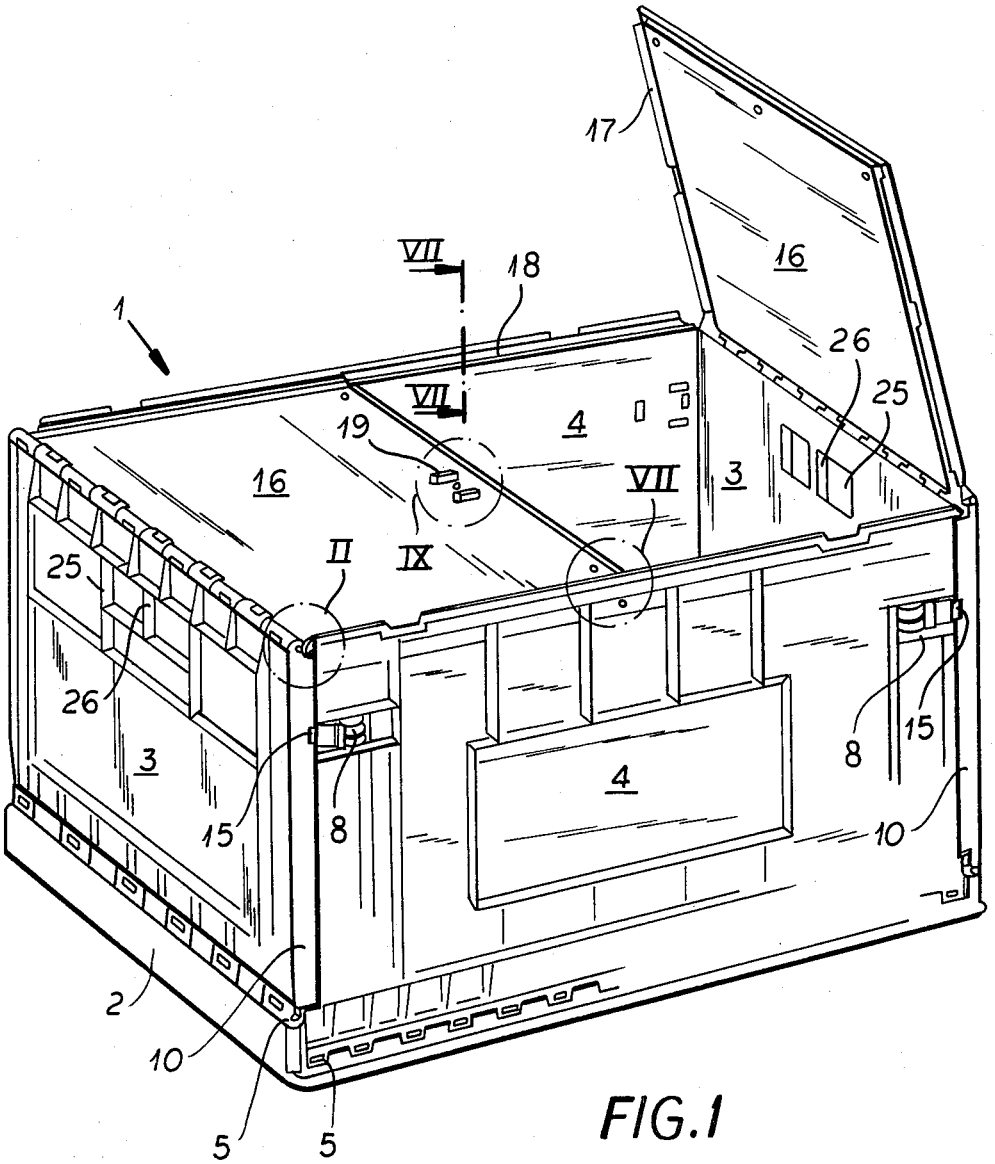
FIG. 1 is a perspective view of a carrying case made in accordance with the invention.

The collapsible carrying case 1 which is depicted in FIG. 1 consists of a base plate 2 and two pairs of oppositely located first and second side walls 3, 4 which are articulate with the base plate 2 by way of hinges 5 so that they may be folded inwardly and downwardly. I the folded position the first side walls 3 lie on top of the second side walls 4. For connecting the side walls 3, 4 together when they are in the opened-up position of the carrying case 1, they have guide members 6, 7 which are not recognizable in FIG. 1 and also interlocking members 8.

It is clearly recognizable in FIG. 1 that the first side wall 3 is provided with edge strips 10 along practically the whole length of the edge which is perpendicular to the base plate 2 in the opened-up position to provide a seating contact for the second side walls 4.

With reference to FIGS. 2 to 6, the connecting- and locking-systems for connecting together the side walls 3, 4 of the carrying case 1 in accordance with the invention will now be described in detail.

Figure 3:
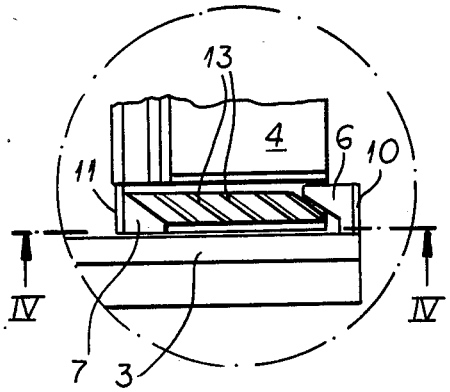
FIG. 3 is a further view of the corner region from FIG. 2 with the second side wall folded into a sloping position.
Figure 4:
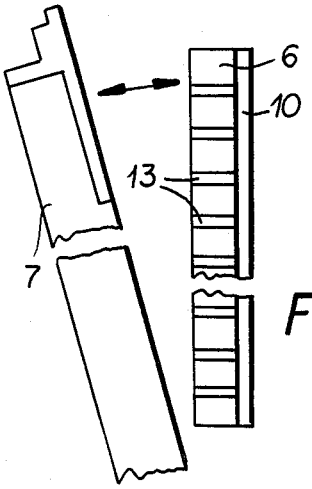
FIG. 4 is a cross-sectional view along IV—IV in FIG. 3.

As FIGS. 3 and 4 show, the guide members 6 on the edge strip 10 are configured as strips which project inwardly over practically the whole length of the edge strips 10 and along the edges of the second side wall 4 which run perpendicular to the base plate 2. There are also edge strips 11 and guide members 7 which are configured to be complementary to the locating strips 10 and guide members 6 on the first side wall 3 and in the opened-up position of the side walls 3, 4 they engage with one another in a tongue-and-groove relationship.

Figure 2:
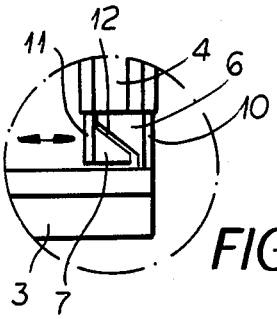
FIG. 2 is a plan view of the enlarged corner region II of FIG. 1.

From FIG. 2 it is clear that the guide members 6, 7 have a substantially triangular cross-section and the side walls 3, 4 in the opened-up position come into contact with one another on the bearing surfaces 12 of the guide members 6, 7 to form an acute angle with the direction of the folding movement of the second side wall 4. The direction of the folding movement of the second side wall 4 is indicated in FIGS. 2 and 4 by means of the double-headed arrows.

Figure 5:
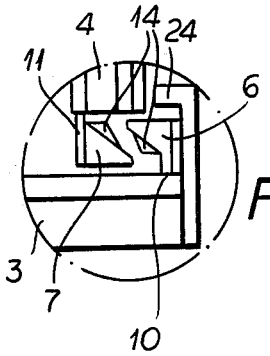
FIG. 5 is the corner region II of a second embodiment of a carrying case in accordance with the invention in a representation corresponding approximately to that in FIG. 3.
Figure 6:
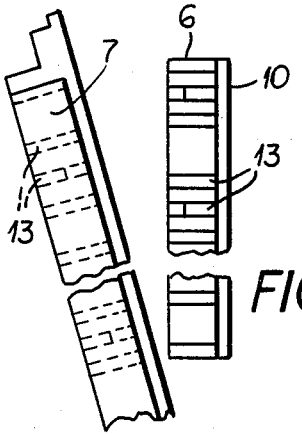
FIG. 6 is a cross-sectional view of FIG. 5 in a representation corresponding roughly with that of FIG. 4.

FIGS. 3 and 4, as well as FIGS. 5 and 6, show that the guide members 6, 7 possess strengthening ribs 13 which are perpendicular to the edge strips 10, 11. The bearing surfaces 12 of the guide members 6, 7 which come into contact with one another are formed by the free edges of the strengthening ribs 13 as shown in the example of embodiment of a carrying case 1 depicted in FIGS. 2, 3 and 4. As opposed to this some of the strengthening ribs 13 in the embodiment depicted in FIGS. 5 and 6 possess positive-locking extensions which project out as indicated by 14 from the bearing surfaces 12 of the guide members 6, 7 which come into contact when the side walls 3, 4 are in the opened-up position. This can be most clearly recognized in FIG. 5. The strengthening ribs 13 which possess the positive-locking extensions 14 on the alternate guide elements 6, 7 are staggered in relation to one another so that the positive-locking extensions 14 intermesh between the strengthening ribs 13 somewhat in the manner of a zip-fastener (FIG. 6). Thus, in the opened-up position of the carrying case 1 guide members 6, 7 come into positive-locking engagement with one another in the direction perpendicular to the base plate 2 so that any relative vertical movement between the side walls 3, 4 is thereby prevented.

In addition to this it may be seen from FIG. 1 that the interlocking members 8 are configured as separate insertion components and they are located in the second side walls 4. On the contrary, what is only broadly indicated in FIG. 1 is that the interlocking members 8 in the second side walls 4 have corresponding locking recesses associated with them in the edge strips 10 on the first side walls 3. The interlocking members 8 as shown generally consist of integral units formed from elastic synthetic material, namely a carbon-fibre reinforced synthetic material, which, for pre-tensioning of the interlocking elements 8, are fabricated to include a leaf or blade spring.

Figure 7:
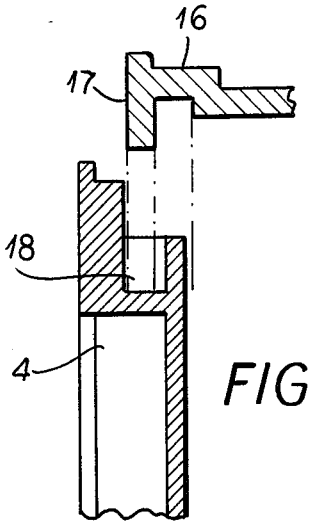
FIG. 7 is a section along the line VII—VII in FIG. 1.

FIGS. 1 and 7 depict an especially preferred form of a lid 16 which is pivotably articulated with the upper edge of each of the first side walls 3 in which case, on the one hand, the lid 16 on its edges extending along the second side wall 4 and, on the other hand, the second side walls 4 along their upper edges which are free in opened-up position are provided with connecting elements 17, 18 which engage with one another when the lids 16 are in the closed position. The connecting elements 17 on the lids 16 are configured as connecting strips which extend for practically the whole length of the side of the lid 16, whereas the connecting elements 18 on the side walls 4 are configured as connecting grooves over practically the whole length of the side walls 4 to accommodate the connecting strips on the lids 16 in a tongue-and-groove relationship.

Furthermore, FIG. 1 indicates that the lids 16 are furnished with handling grips 19 close to their edges which are in contact when the lids are in the closed position. This can be seen more clearly in FIG. 9.

Figure 8:
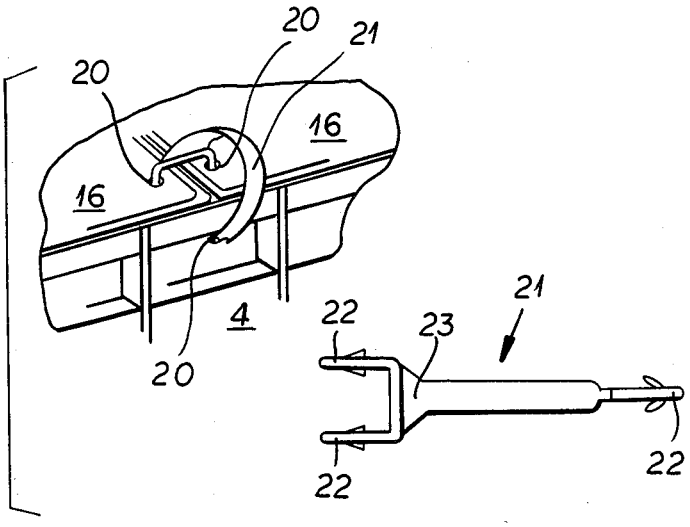
FIG. 8 is an enlarged perspective view of the region VIII in FIG. 1, with the locking device inserted into position.
Figure 9:
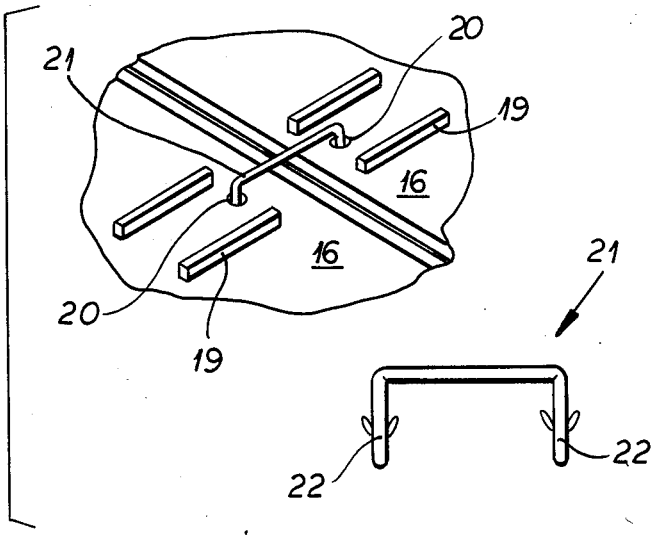
FIG. 9 is an enlarged perspective view of the region IX in FIG. 1, with the locking device inserted into position.

From FIGS. 8 and 9 it will be further evident that the lids 16 are provided with insertion openings 20 for a locking device 21 close to their edges which are in contact in the closed position. The lids 16 are also provided with insertion openings 20 for the locking device 21 close to their side edges, in which case it may be seen from FIG. 8 that the second side walls 4 are also provided with insertion openings 20 for the locking device 21 close to their free upper edges in the opened-up position.

In FIGS. 8 and 9 the preferred type of locking device 21 is configured as connecting strips 23 which are furnished with springy finger elements 22 close to their ends. The locking device 21 utilized in the embodiment depicted in FIG. 8 has a set of two finger elements 22 located substantially in parallel at the one end and at the other end it has only a single finger element 22. The manner in which this locking device 21 is to be inserted into the insertion openings 20 in the carrying case 1 will be apparent from FIG. 8.

The locking device 21 which is essentially of a U-shape with a finger element 22 at either end serves for the locking connection of the two lids 16 with one another as depicted in FIG. 9.

Finally, FIG. 5 depicts a particularly preferred embodiment for use under severe transport conditions with heavy loading because the first side walls 3 are here provided with further additional-locking elements 24 which are seated up against the outside of the second side walls 4 when these are in the opened-up position.

It can also be seen from FIG. 1 that hand holes 25 for lifting and carrying are provided in the first side walls 3 which, for reasons of pilfer-proofing are divided into two parts by a central web 26.

The whole carrying case 1 which has been hereto described in detail is formed of a thermoplastic synthetic material which is capable of being injection moulded, but it can naturally also be fabricated from wood, metal or other materials.

The claims defining the invention are as follows:

1. A collapsible container, comprising:

a rectangular base plate having a pair of opposite short sides and a pair of opposite long sides;

a respective generally rectangular side wall hinged to said base plate along each of said long sides and adapted to be folded from erect positions inwardly to overlie said base plate;

a respective generally rectangular end wall hinged to said base plate along each of said short sides at locations above that at which said side walls are hinged to said base plate and adapted to be folded from erect positions inwardly to overlie said side walls, each of said end walls being provided along opposite edges which are vertical in said erect positions of said end walls with a triangular cross section ridge having a free edge turned inwardly and defined by a first flank parallel to the plane of the respective end wall, a second flank at a right angle to said first flank, and a third flank inclined at an acute angle toward said first and second flanks, each of said side walls being provided along opposite edges which are vertical in said erect positions of said side walls with a triangular cross section ridge having a free edge turned outwardly and defined by a first flank parallel to the plane of the respective side wall, a second flank at a right angle to said first flank, and a third flank inclined at an acute angle toward said first and second flanks, said third flanks of adjoining ridges of each end wall and an adjacent side wall at each vertical edge of said container being in abutting and engaging contact to hold said walls erect; and a pair of cover plates of rectangular configuration, each of said cover plates being hinged to an upper edge of a respective one of said end walls and being formed along opposite sides of the cover plate perpendicular to the respective upper edge with a downwardly extending lip, each of said side walls being formed along an upper edge thereof with a respective groove, each of said grooves receiving the lips of both said cover plate along the respective side of the container.

2. The collapsible container defined in claim 1, further comprising strengthening ribs spaced apart along each of said ridges and extending generally perpendicular thereto.

3. The collapsible container defined in claim 2 wherein bearing surfaces of mutually engaging ridges of said end walls and said side walls are formed by free edges of said ribs.

4. The collapsible container defined in claim 2 wherein said strengthening ribs of adjoining ridges are formed with mutually engaging positive locking formations.

5. The collapsible container defined in claim 1, further comprising a locking member having respective legs engageable in both of said cover plates and a further formation engageable in one of said side walls.

6. The collapsible container defined in claim 2 wherein said locking member comprises a strip of elastic material formed integrally with said legs and said further formation.

7. The collapsible container defined in claim 1, further comprising a locking member of U-shaped configuration having a pair of legs engageable in holes formed in said cover plates along an edge at which said cover plates meet.

* * * * *